United States Patent [19]

Labus

[11] 4,028,023

[45] June 7, 1977

[54] FLUID OPERABLE ROTARY PISTON DEVICE

[75] Inventor: Herwig Labus, Julich, Germany

[73] Assignee: Kernforschungsanlage Julich Gesellschaft mit beschrankter Haftung, Julich, Germany

[22] Filed: Nov. 26, 1975

[21] Appl. No.: 635,661

[30] Foreign Application Priority Data

Nov. 28, 1974 Germany ..... 2456252

[52] U.S. Cl. ..... 418/108; 418/127; 418/168; 418/178

[51] Int. Cl.[2] ..... F01C 1/10; F01C 19/04; F01C 21/10

[58] Field of Search ..... 418/104, 107, 108, 127, 418/168–171, 178

[56] References Cited

UNITED STATES PATENTS

| | | | |
|---|---|---|---|
| 708,328 | 9/1902 | Eek et al. | 418/127 |
| 724,665 | 4/1903 | Cooley | 418/168 |
| 1,268,782 | 6/1918 | Mathes | 418/127 |
| 1,717,739 | 6/1929 | Seifert | 418/168 |
| 1,719,640 | 7/1929 | Wilsey | 418/169 |
| 2,053,919 | 9/1936 | Pigott | 418/168 |
| 3,071,314 | 1/1963 | Flanagan | 418/178 |

FOREIGN PATENTS OR APPLICATIONS

| | | | |
|---|---|---|---|
| 547,826 | 4/1932 | Germany | 418/168 |
| 1,403,899 | 2/1969 | Germany | 418/169 |
| 961,872 | 6/1964 | United Kingdom | 418/168 |
| 394,985 | 7/1933 | United Kingdom | 418/168 |
| 753,772 | 8/1956 | United Kingdom | 418/178 |

*Primary Examiner*—John J. Vrablik
*Attorney, Agent, or Firm*—Walter Becker

[57] ABSTRACT

A fluid operable rotary piston device having a housing with gas inlet and outlet means and a hollow cylinder rotatable therein having gas inlet and gas outlet ports which communicate with the gas inlet and outlet means during rotation of the cylinder. A rotary piston is rotatable on an eccentric axis inside the cylinder and the cylinder and piston have interengageable means forming contact free working chambers. Axial sealing strips are mounted on one of the piston and cylinder and form contact free sealing gaps between adjacent working chambers. The cylinder rotates in the housing in contact free relation therewith and a transmission connects the piston and cylinder for rotation at respective speeds.

7 Claims, 2 Drawing Figures

FLUID OPERABLE ROTARY PISTON DEVICE

The present invention relates to a piston engine for compressing or expanding gases which is designed as a rotary or circular piston engine with at least one outlet and one inlet opening for the housings containing the gases. More specifically, the present invention concerns a rotary piston engine of the above mentioned type in which the housings have a hollow chamber in which as an outer engaging body with intake and outlet openings for the gases there is provided a hollow cylinder which forms gaps with the inner wall of the hollow chamber along the surfaces facing each other, said hollow cylinder being rotatably mounted for rotation about the central axis of said hollow chamber. In said hollow chamber there is provided a shaft which is designed as inner engaging body and which is journalled for rotation about an axis guided in the hollow chamber at a predetermined distance with regard to the axis of the hollow cylinder. As an alternative, the housing comprising at least one outlet and one inlet, opening is designed as a resting outer engaging body in which a shaft designed as inner engaging body is rotatably journalled in such a way that said shaft rotates about its center gravity which simultaneously rotates, while the two engaging bodies are coupled to each other through a transmission arranged outside said cylindrical hollow chamber and while those surfaces of the two engaging bodies which face each other are so shaped that between said last mentioned surfaces along surfaces parallel to each other and facing each other as well as along equi-distant straight lines parallel to the axis of rotation there are formed gaps at a minimum distance from each other so that with a rotation at the respective different angular velocity of the two engaging bodies working chambers are formed which extend parallel to the axes of rotation and are variable as to their size.

Engines for compressing or expanding gases are frequently employed in technical installations. Inasmuch as for instance during the compression of gases, a portion of the mechanical work is converted into heat, the gases as well as the housing of the engines are cooled by a cooling medium, for instance air or water in order to maintain the walls of the working chamber which are wetted by an oil layer, at a temperature which the employed oil will stand. Disadvantageous results of such an arrangement consist in a reduction of the technical degree of efficiency of such heretofore known engines.

It is, therefore, an object of the invention to provide an engine for compressing or expanding gases which will make it possible so to compress or expand gases in an economical manner that the average pressure ratio of the starting pressure increases toward the end pressure up to five times its starting pressure or drops to one-fifth of said starting pressure without requiring a cooling of the gases or of the engine. This should also apply to hot gases which have temperatures at which the material of the walls of the working chambers will just still be tolerated.

These and other objects and advantages of the invention will appear more clearly from the following specification in connection with the accompanying drawings, in which.

Figure 1:
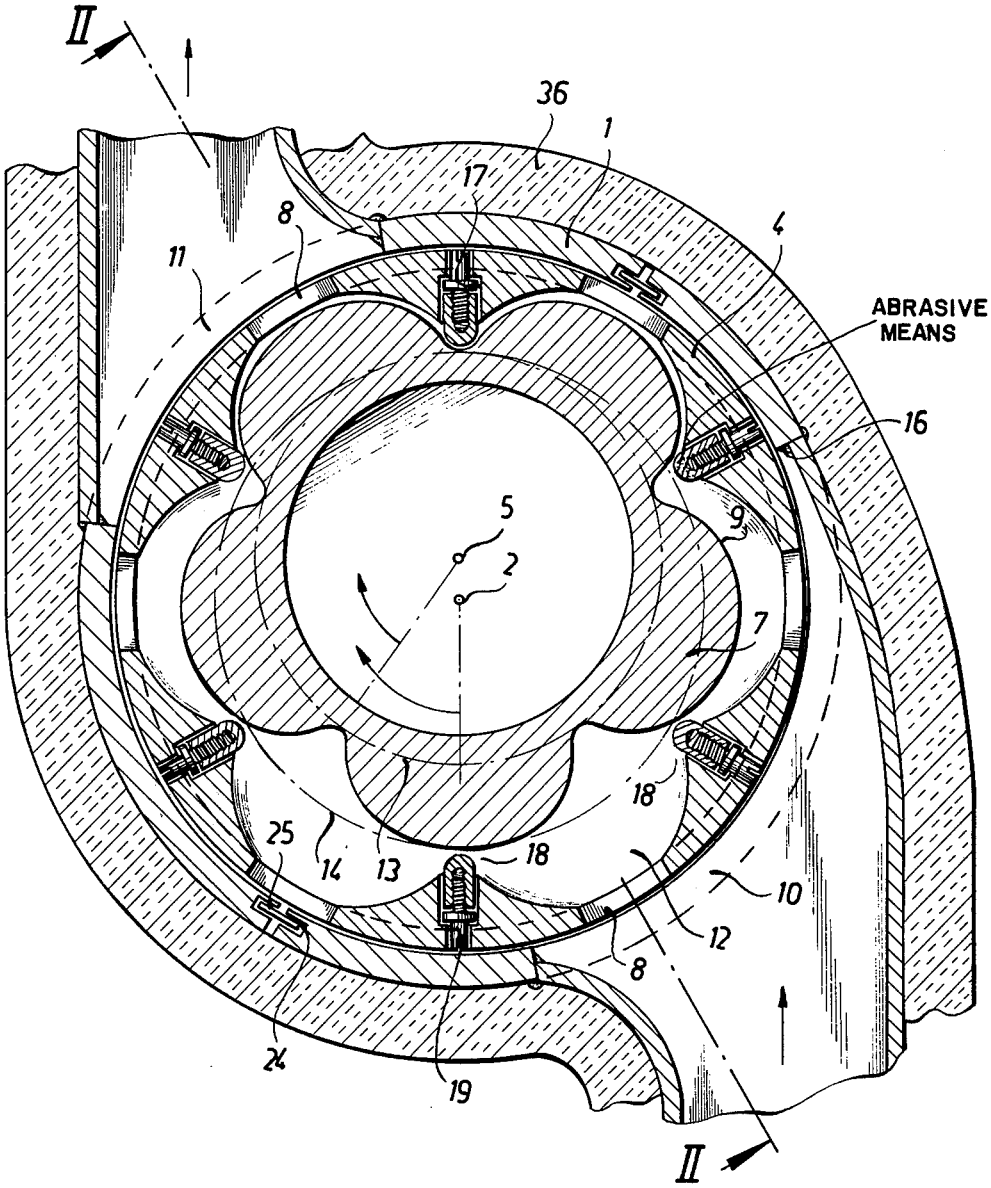
FIG. 1 is a cross section through a rotary piston engine according to the present invention, said cross section being taken along the line I — I of FIG. 2.

The above outlined object has been realized by a piston engine according to the present invention which is characterized primarily in that sealing strips which are adjustable in radial direction are so arranged on one of the engaging bodies while being parallel to the axes of rotation and facing the surface of the other engaging body that for sealing the working chambers in a contact-free manner, sealing gaps are formed with a gap width which remains the same when the engaging bodies rotate.

The driving or output forces are absorbed from one of the engaging bodies depending on the type of operation of the engine as compression or expansion engine. The compression of the gases is effected by the fact that the gases drawn in through the inlet opening are guided and compressed in the working chambers which form between the two engaging bodies, said working chambers being separated from each other by contact-free gap seals. The two engaging bodies rotate at a predetermined speed of the engine with a respective constant but different velocity. Inlet and outlet openings are so arranged in the housing that when the engine is operated as compression engine, the working chambers are greatest at the inlet side and are smallest at the outlet side. In order to operate the engine as expansion engine, it will suffice to run the inner engaging body in a reverse direction of rotation. That opening which when running the engine as compression engine serves an inlet opening will then serve as outlet opening. This correspondingly applies to the opening which when running the engine as compression engine serves as outlet opening.

Due to the contact-free seal of the working chambers by means of gap seals, it will be realized if the working chamber walls consist of high heat-resistant material such as high heat-resistant steels, that the engine can be heated during operation to temperatures of up to 1,000° C. In this connection, the gas losses through the gap seals are at high speeds for instance at speeds of about 20,000 RPM and a compression up to 5.0 with a diameter of the engine of about 10 centimeters and a length of about 15 centimeters, with gap widths within ranges of from 0.1 to 0.5 millimeters less than the friction and heat transfer losses with heretofore known engines having the same delivery with cooled working chamber walls and sliding seals with oil lubrication. Due to the fact that the sealing strips for adjusting the contact-free sealing gaps are adjustable in radial direction, it is possible at any time when the engine is at a standstill to readjust the gaps whereby it is simultaneously made possible that during the machining of the two engaging bodies, it is not necessary that precise tolerance be maintained. The sealing strips are expediently made of heat- and corrosion-resistant materials such as ceramics, high-alloyed steel or glass types suitable for this purpose. In this connection, it is of particular advantage that for forming the contact-free sealing gaps, at least one of the sealing strips consists of an abrasive. As material for such sealing strips there may be employed materials such as corundum or the like.

A particularly advantageous modification of the piston engine according to the invention consists in that the piston engine is designed as rotary piston engine with a housing having a cylindrical hollow chamber. The hollow cylinder designed as outer engaging body comprises a plurality of recesses which extend on its inner wall parallel to the axis of the hollow cylinder and are of the same shape and arranged at equal distance from each other. In the foot portion of said recesses there are arranged openings designed an intake and outlet openings for the gases. On the circumference of the shaft designed as inner engaging body there are provided beads which extend in an axis-parallel manner, are adapted to the shape of the recesses and form with the recesses working chambers while acting as pistons. These beads are so shaped that their cross section is represented by a trochoid which, due to the movement of the two engaging bodies relative to each other, which relative movement is effected during the turning of the two engaging bodies, are generated by the points which are located on the inner surface of the hollow cylinder, are closest to the axis of the hollow cylinder and during the rotation engage the surface of the shaft. With this modification of the piston engine according to the invention, the adjustable sealing strips are arranged on the crests between the recesses. An advantageous embodiment of the piston engine according to the present invention consists in that the housing for adjusting contact-free sealing gaps along those surfaces of the hollow cylinder which face each other and along the inner wall of the cylindrical hollow chamber of the housing consists of segments which are connectable to each other and displaceable in radial direction, whereby gap widths of less than 0.1 millimeter are adjustable. As seals between the segments expediently sealing strips of heat-resistant material are employed which are insertable into grooves arranged in the longitudinal sectional surfaces of the segments. The thus formed gaps between the segments simultaneously serve advantageously as expansion gaps against stresses occurring in the housing due to temperature drops.

Inlet opening and outlet opening are expediently so designed in the housing comprising a cylindrical hollow chamber that they extend over the entire length of the housing. In this connection, it is advantageous that the openings arranged in the bottom portion of the recesses are designed as openings which extend over the entire length of the hollow cylinder and are interrupted by narrow webs. This brings about that the openings due to their large cross section will even at maximum speeds of rotation represent a negligible flow resistance while at the same time the outer engaging body has sufficient strength. In this connection, it is furthermore advantageous that the openings arranged in the lower portion of said recesses are respectively located at the thinnest wall portions of the outer engaging body. As a result thereof, an extremely low dead volume will be realized. The piston engine according to the invention, in spite of a minimum space requirement, has a high delivery volume.

A further advantageous embodiment of the piston engine according to the invention consists in that the defining edge of the opening in the housing which determines the opening angle and which when operating the piston engine as compression engine serves as inlet opening, is so arranged that the openings in the lower portion of the recesses of the hollow cylinder when operating the piston engine as compression engine, reach the defining edge only when the gas in the openings in the lower portion of the recesses has expanded to the outer pressure. As a result thereof, a particularly economical operation of the piston engine according to the invention will be realized. With not too low a number of beads, for instance 5 beads, on the shaft designed as inner engaging body, it will be brought about that the exhaust operations of adjacent working chambers timewise are superimposed while, for all practical purposes, a continous gas discharge will be realized.

It is expedient that the transmission provided for coupling the shaft designed as inner engaging body and of the hollow cylinder designed as outer engaging body is designed as gear with inner teeth arranged at the end faces of the hollow cylinder and as gear respectively arranged at the end faces of the shaft and meshing with the respective gear of the hollow cylinder. It is advantageous in this connection that the gears are arranged between the end faces of shaft and hollow cylinder and the bearings of shaft and hollow cylinders. Such an arrangement brings about a compact construction and an optimum power transfer.

A particularly advantageous design consists in a piston engine according to the invention with contact-free sealing gaps as compression and/or expansion engine in a combustion engine operated as hot air engine and in which one or more compresion engines and a combustion chamber adapted to be charged with combustible substances in a continuous manner and under constant pressure has a volume sufficient for a long stay of the combustible substances and also comprises one or more expansion engines which follow said combustion chamber and are spatially separated from each other through connecting conduits. Between the compression engine or engines and said combustion chamber there is provided a heat exchanger which is passed through by the gases compressed in said compression engine or engines and which in counter current to the compressed gases is passed through from the waste gases of the expansion engine or engines. The piston engine according to the invention is expediently operated at a speed of revolution within the range of from 5,000 to 35,000 RPM at a compression or expansion with a pressure ratio of the gases of from 2.0 to 5.0.

Referring now to the drawings in detail, the piston engine according to the invention operable as compression and expansion engine, comprises a housing 1 with a cylindrical hollow chamber, a hollow cylinger 4 designed as outer engaging body and in the housing 1 coaxially arranged for rotation about the axis 2 of the cylindrical hollow chamber in the bearing 3 and in an additional bearing 3 not shown in the drawings. The said piston engine furthermore comprises a shaft journalled in the bearing 6 and having an axis 5 which extends parallel to and is arranged in spaced relationship to the axis 2 of the hollow cylinder. The piston engine furthermore comprises an additional shaft 7 which is designed as inner engaging body rotatably mounted in a further bearing 6 not illustrated in the drawing. The bearings, which are connected to an oil circuit indicated in FIG. 2 by dotted arrows, are expediently designed as needle or conical roller bearings. Bearing 3 has, depending on the size of the bearing 6, a diameter of from about 30 to 46 millimeters which thus is less than half the size as the diameter of the comparatively same bearings for the two-shaft-rotary piston engines designed as compression and/or expansion engine is conformity with the above suggestion. At the same speeds and the same delivery volume of both engines, therefore, bearing 3 reaches comparatively low path speeds so that with the piston engine according to the invention at least twice as high speeds can be obtained. On the inner wall of the hollow cylinder 4 parallel to the axis 2 of the hollow cylinder, recesses are arranged which in their foot or lower portion comprise openings 8. In the circumference of shaft 7, there are arranged beads which act as pistons, are axis-parallel and are adapted to the shape of the recesses while the enveloping curve 9 thereof is designed as trochoid. When operating the piston engine according to the invention as compression engine, hollow cylinder 4 and shaft 7 rotate in the direction indicated in FIG. 1 by arrows. Opening 10 of housing 1 will then serve an inlet opening, and opening 11 will serve as outlet opening for the gases. As will likewise be evident from FIG. 1, between the beads and the recesses, working chambers 12 are formed. The greatest working chamber forms on the connecting line between the axes 2 and 5 at the inlet opening 10, and the smallest working chamber forms likewise on the connecting line on the side where the outlet opening 11 is provided. When shaft 7 and hollow cylinder 4 are rotated, the gas is drawn in through the inlet opening 10 and conveyed into the decreasing working chamber 12 where it is compressed and from which it is subsequently exhausted through the outlet opening 11. The openings 10 and 11 are with the engine illustrated in the drawing so designed that with an addendum 14 of the hollow cylinder 4 having a radius of 4.2 centimeters and with a dedendum 13 of shaft 7 having a radius of 3.5 centimeters and with suitably designed openings 8, a compression of from 2.5 to 3 will be realized. As is only partially shown in FIG. 2, the openings 8 extend over the length of the hollow cylinder and are interrupted only by narrow webs 15. With an engine length of 15 centimeters, a total intake volume of 720 $cm^3$ per revolution will be obtained.

The confining edge 16 which determines the opening angle of the inlet opening 10 is so arranged that the openings 8 in the hollow cylinder 4 will when operating the engine as compression engine, reach the confining edge 16 only when the gas in the openings 8 has expanded to the outer pressure.

As will be evident from the drawing, sealing strips 18 are provided in grooves 17 in the crests between the recesses of the hollow cylinder 4. These sealing strips 18 are adjustable by means of screws 19. The sealing strips 18 are on that side thereof which faces the shaft 7 designed semi-circularly but, as shown in the drawing, may also be designed in a wedge-shaped form. Between the sealing strips 18 and the marginal curve 9 of the beads, gaps are formed which act as gap seal and by means of which the working chambers 12 are separated from each other. At least one of the sealing strips 18 includes abrasive means at least at the end forming the sealing gap.

At the end faces of the hollow cylinder 4 there are provided at the annular discs 20 gears 21 with inner teeth (only one gear being shown), and at the end faces of shaft 7 at the drive shaft 22, gears 23 with outer teeth are provided of which likewise only one gear is shown, said gears being arranged between shaft 7 and hollow cylinder 4 and the bearings 3 and 6. The gears 21 and 23 which, similar to the bearings 3 and 6, are oil lubricated, mesh with each other and prevent the sealing strips 18 from being pressed against the beads of shaft 7 when a change in the speed occurs, thereby preventing a premature wear of said sealing strips.

Figure 2:
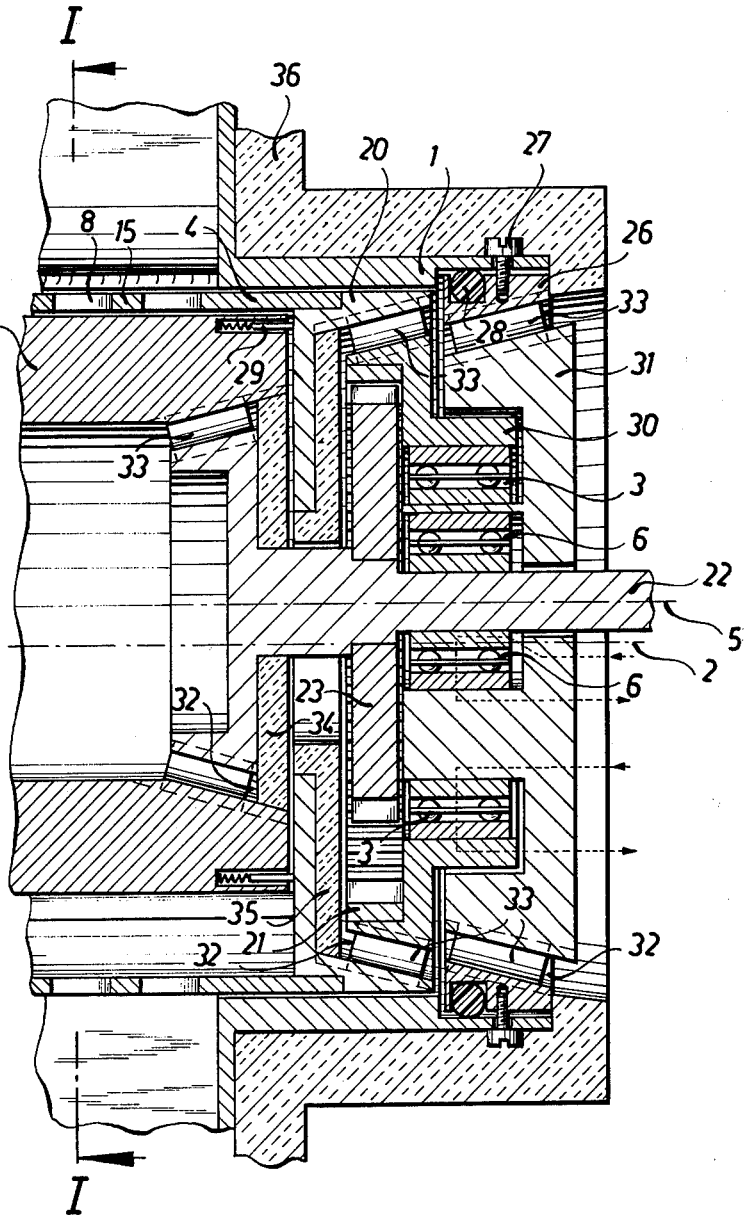
FIG. 2 represents a partial longitudinal section taken along the line II — II of FIG. 1.

In order to be able to adjust the gap between the inner wall of housing 1 and the outer wall of hollow cylinder 4, housing 1 is, as shown in FIG. 1, sub-divided into two semi-cup-shaped segmets. The two segments are at their longitudinal sides provided with grooves 24 into which for purposes of sealing the two segments, sealing strips 25 are inserted. The segments of housing 1 are by means of screws 27 with fine thread connected to stabile end face rings 26. Embedded in said rings 26 in grooves thereof are elastic sealing rings 28 which are highly heat-resistant and which press the segments against the tightening force of the screws 27 toward the outside. In this way, the distance between housing 1 and the outer wall of the hollow cylinder 4 is adjustable by some tenths of a millimeter.

For purposes of sealing shaft 7 against annular discs 20, at the end face in shaft 7 there are provided semi-circular grooves 29 in which the sealing strips are arranged. The sealing strips are under a slight spring pressure and are adapted to slide along on the annular disc 20. The relative speed of the end faces of shaft 7 and of the disc 20 is low so that the seal will also without the use of lubricants be wear-resistant when suitable material for the seal is selected.

For purposes of heat insulation, between the end face ring 20 connected in the hollow cylinder 4 and the ring 30 surrounding the bearings, as well as between shaft 7 and the drive shaft 22 for shaft 7 and between the end face ring 26 of housing 1 and the ring 31, air gaps 32 are provided which have a thickness of a few millimeters. For mechanically connecting the parts separated from each other by air gaps, and for maintaining the air gaps, inclined hollow cylinders 33 are provided which are made of highly stress-resistant material which is a poor heat conductor such as quartz, glass or porcelain. These hollow cylinders are embedded in the oppositely located cylindrical depressions arranged in the parts which are mechanically firmly to be connected to each other. By means of non-illustrated screw connections or by pressure springs, the parts to be connected are through the intervention of the hollow cylinders pressed against each other in axial direction. This brings about that the parts, even though they can be displaced relative to each other in axial direction in case they undergo different heat expansion, will nevertheless remain in a reliable frictional connection and will remain properly centered.

Discs 34 and 35 of heat-insulating materials such as insulating materials known under the trade name "Triton Kaowool" prevent the heat transfer by radiation and convection between hot and cold wall parts. In order to prevent heat losses toward the outside, housing 1 and also the connecting lines between the compression engine, combustion chamber, and expansion engine are, when employing the piston engine according to the invention is an internal combustion engine of the above mentioned type, enveloped or enclosed in an insulating cup 36.

It is, of course, to be understood that the present invention is, by no means, limited to the specific showing in the drawings but also comprises any modifications within the scope of the appended claims.

What is claimed is:

1. In a fluid operable rotary piston device; a housing including means forming a cylindrical chamber therein with gas inlet and gas outlet means, a hollow cylinder rotatable on the central axis thereof in said chamber with radial clearance and having gas openings which communicate with said inlet and outlet means as said cylinder rotates in said chamber, a piston eccentrically mounted in said cylinder and rotatable therein on the central axis of the piston, transmission means connecting the piston and cylinder for rotation at respective speeds, said cylinder having inwardly concave axial recesses therein and said piston having outwardly convex axial protruberances therein receivable in said recesses as the cylinder and piston rotate, said recesses and protruberances forming working chambers between the cylinder and piston which vary in size as the cylinder and piston rotate, means supporting said piston and cylinder in said housing for rotation of the piston and cylinder on the respective central axes thereof while supporting the piston and cylinder in contact free relation, and axial sealing strips on one of said cylinder and piston for sealing between adjacent working chambers, and means for adjusting the sealing strips radially to provide for contact free sealing gaps between adjacent working chambers, said cylindrical chamber is said housing and said cylinder having a contact free sealing gap between the opposed surfaces thereof, said means in the housing forming said chamber being segmented with the segments thereof being relatively adjustable to control the said gap between the gap between the cylindrical chamber and the cylinder.

2. A fluid operable rotary piston device according to claim 1 in which at least one of said sealing strips includes abrasive means at least at the end forming the sealing gap.

3. A fluid operable rotary piston device according to claim 1 in which the axial recesses in said cylinder are uniform in size and uniformly circumferentially spaced in the cylinder, said gas openings in said cylinder being formed in the bottom portions of said recesses, said protruberances on said piston also extending axially and mating with said recesses in close contact free relation, both of said recesses and protruberances being substantially trochoidal in configuration.

4. A fluid operable rotary piston device according to claim 1 in which said gas openings in said cylinder extend axially substantially the full length thereof while being interrupted by circumferential strips forming a part of the cylinder and which strips are axially narrow.

5. A fluid operable rotary piston device according to claim 1 in which said cylinder has a said gas opening for each said recess, said opening communicating with the inlet opening means in the cylindrical chamber when the device is operating as a compression engine only when the pressure in the respective recess is at about the same pressure as the pressure at the inlet opening means.

6. A fluid operable rotary piston device according to claim 1 in which said transmission means comprises internal gear means coaxially connected to said cylinder, and external gear means coaxially connected to said piston and meshing with said internal gear means.

7. A fluid operable rotary piston device according to claim 1 which includes bearings supporting said cylinder and piston for rotation on the respective central axes thereof, said transmission means comprises internal gear means coaxially connected to said cylinder, and external gear means coaxially connected to said piston and meshing with said internal gear means, said gear means being located between the said bearings and the ends of said cylinder and piston.

* * * * *